US007281357B2

(12) United States Patent
Femminella

(10) Patent No.: US 7,281,357 B2
(45) Date of Patent: Oct. 16, 2007

(54) PREFABRICATED COMPONENTS FOR MAKING FLOOR SLABS, FLOORS AND WALLS WITH EXPOSED WOOD BEAMS FOR SMALL BUILDINGS

(75) Inventor: Giovanni Femminella, Rome (IT)

(73) Assignee: Coperlegno S.r.l., Rome (IT)

( * ) Notice: Subject to any disclaimer, the term of this patent is extended or adjusted under 35 U.S.C. 154(b) by 153 days.

(21) Appl. No.: 10/763,330

(22) Filed: Jan. 26, 2004

(65) Prior Publication Data

US 2004/0148885 A1 Aug. 5, 2004

(30) Foreign Application Priority Data

Feb. 3, 2003 (IT) ..... BO2003A0046

(51) Int. Cl.
*E04B 5/18* (2006.01)

(52) U.S. Cl. ..... 52/334

(58) Field of Classification Search ..... 52/320, 52/332, 334, 335, 338, 432, 435
See application file for complete search history.

(56) References Cited

U.S. PATENT DOCUMENTS 2,040,350 A * 5/1936 Wernette ..... 52/375
3,203,146 A * 8/1965 Carter ..... 52/328
3,864,888 A * 2/1975 Tupper et al. ..... 52/745.05
4,573,303 A * 3/1986 Figari ..... 52/742.14
5,125,200 A * 6/1992 Natterer ..... 52/223.8
5,561,957 A 10/1996 Gauthier et al.

FOREIGN PATENT DOCUMENTS

| | | |
|---|---|---|
| DE | 299 23 879 U1 | 6/2001 |
| EP | 0 859 099 A | 8/1998 |
| EP | 0 870 883 A | 10/1998 |
| FR | 2 824 093 A | 10/2002 |

* cited by examiner

*Primary Examiner*—Naoko Slack
*Assistant Examiner*—Jessica Laux
(74) *Attorney, Agent, or Firm*—Modiano & Associati; Albert Josif; Daniel O'Byrne

(57) ABSTRACT

Prefabricated components for making floor slabs, floors and walls with exposed wood beams for small buildings comprising laminated panels with at least two mutually opposite edges that are affected by longitudinal grooves; laminated wood beams being provided in an upper region with coupling elements for respective central metallic lattices and with at least one supporting ridge for the ends of the panels that have grooved edges; the beams, the lattices and the converging grooved edges being mutually coupled by casting conglomerate.

27 Claims, 8 Drawing Sheets

PREFABRICATED COMPONENTS FOR MAKING FLOOR SLABS, FLOORS AND WALLS WITH EXPOSED WOOD BEAMS FOR SMALL BUILDINGS

BACKGROUND OF THE INVENTION

The present invention relates to prefabricated components for making floor slabs, floors and walls with exposed wood beams for small buildings, mainly for residential use but with the possibility of application also in warehouses and in industrial and farming buildings.

Erecting buildings that have a wooden supporting frame is a very ancient practice; the evolution of technology has allowed to improve their comfort continuously, to the point of providing buildings that are competitive with conventional buildings in terms of thermal and acoustic insulation.

It should be noted that in certain geographical locations, a wooden building entails a considerably reduced environmental impact with respect to a conventional masonry building, and therefore the use of wood in the production of prefabricated buildings is often preferred over other materials.

Using wood to build the entire building entails the use of machines and tools and of a considerable amount of labor, in relation to the weight of the planks, beams, and columns, which in order to have high strength and rigidity must be made of essences that have excellent mechanical properties.

The latest prefabricated buildings are made of various materials that must ensure good thermal and acoustic insulation, must not undergo deformation or deterioration as a consequence of exposure to atmospheric agents, and must have limited weights, yet good structural strength characteristics; in order to erect a prefabricated building constituted by a plurality of lightweight portions that are mutually coupled, it is not necessary to use particular machines (such as large jibs or cranes), since most of the structure can be handled manually by one or more people.

SUMMARY OF THE INVENTION

The aim of the present invention is to obviate the cited drawbacks and meet the mentioned requirements, by providing prefabricated components for making floor slabs, floors and walls with exposed wood beams for small buildings that are aesthetically appreciable, easy to assemble, and have good structural strength.

Within this aim, an object of the present invention is to provide a structure that is simple, relatively easy to provide in practice, safe in use, effective in operation and has a relatively low cost.

This aim and this and other objects that will become better apparent hereinafter are achieved by the present prefabricated components for making floor slabs, floors and walls with exposed wood beams for small buildings, characterized in that they comprise laminated panels with at least two mutually opposite edges affected by longitudinal grooves, laminated wood beams that are provided in an upper region with coupling elements for respective central metallic lattices and with at least one supporting ridge for the ends of said panels that have grooved edges, said beams, said lattices and said converging grooved edges being mutually coupled by casting conglomerate.

BRIEF DESCRIPTION OF THE DRAWINGS

Further characteristics and advantages of the present invention will become better apparent from the following detailed description of a preferred but not exclusive embodiment of prefabricated components for making floor slabs, floors and walls with exposed wood beams for small buildings, illustrated by way of nonlimiting example in the accompanying drawings, wherein.

DESCRIPTION OF THE PREFERRED EMBODIMENTS

Figure 1:
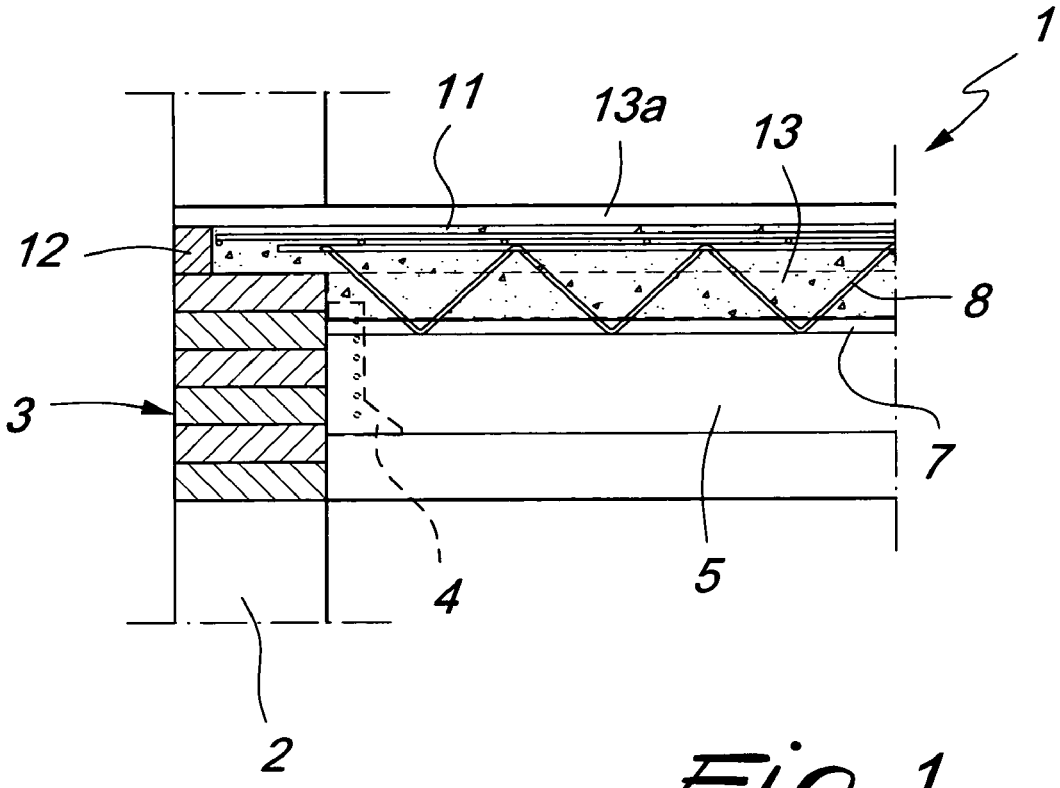
FIG. 1 is a sectional view, taken along a vertical plane that passes through a central beam.
Figure 2:
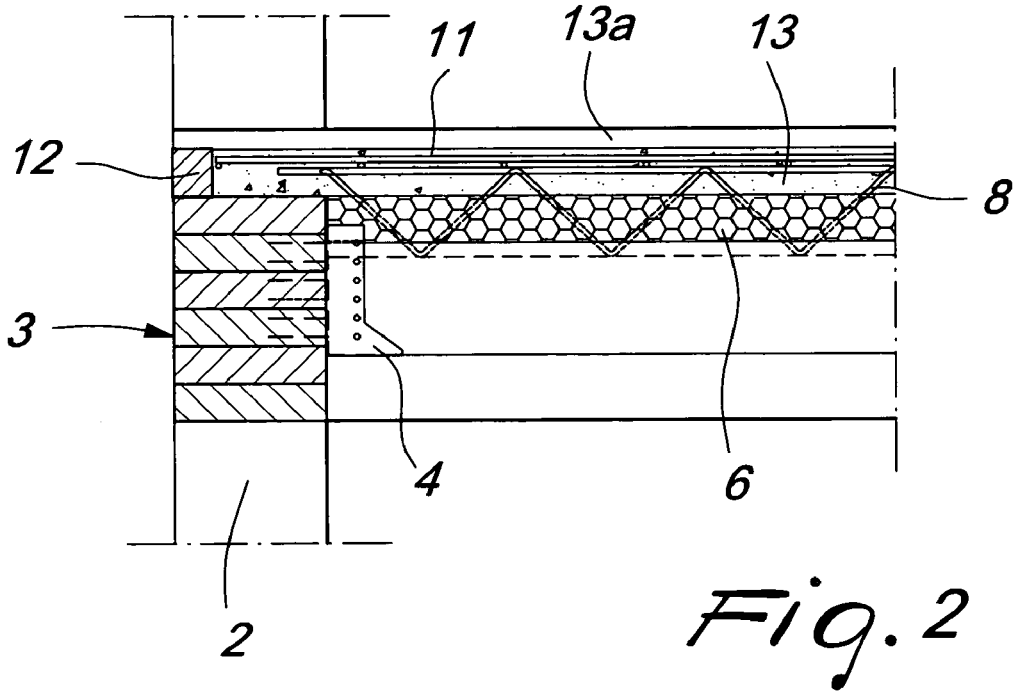
FIG. 2 is a sectional view, taken along a vertical plane that passes through a panel.
Figure 3:
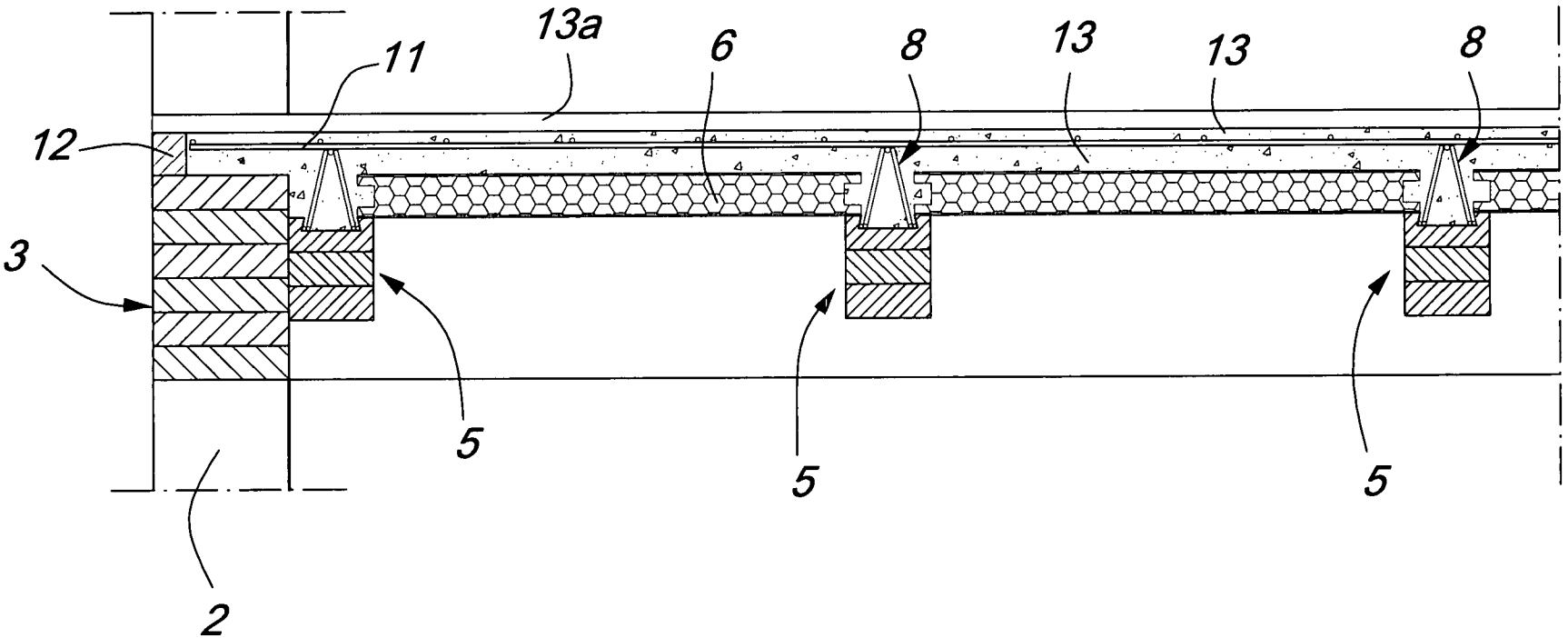
FIG. 3 is sectional view, taken along a vertical plane that is perpendicular to a central beam, of a first embodiment.
Figure 4:
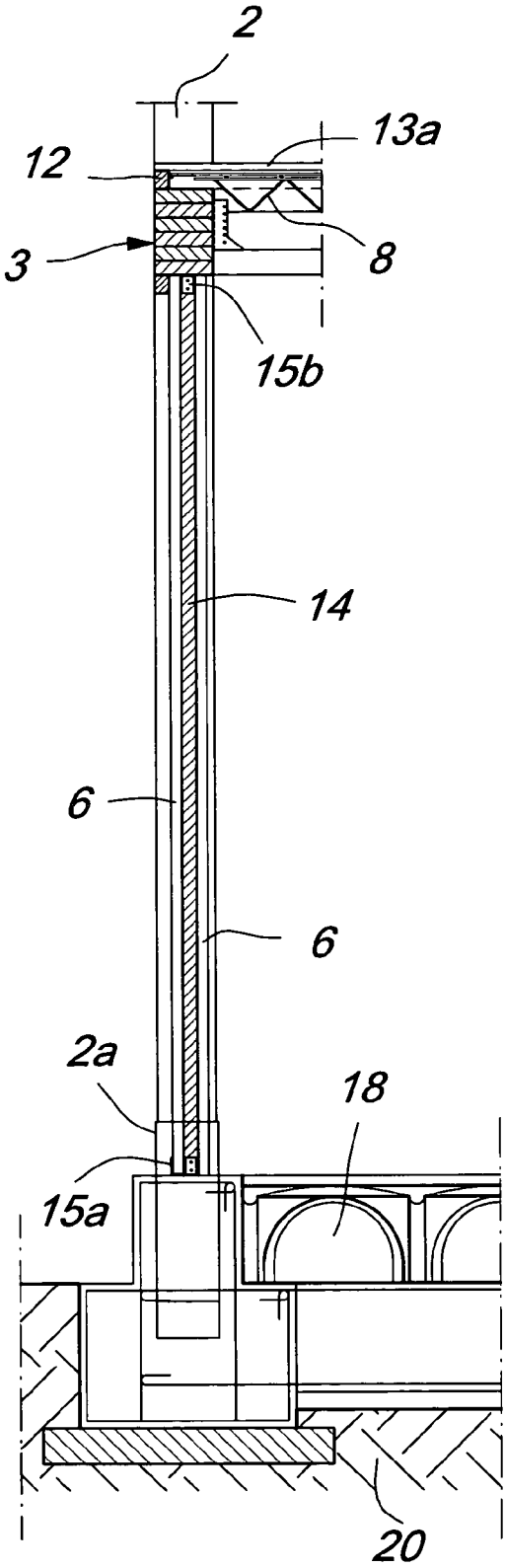
FIG. 4 is a sectional view, taken along a vertical plane that is perpendicular to the wall that passes through the panel connecting elements.
Figure 5:
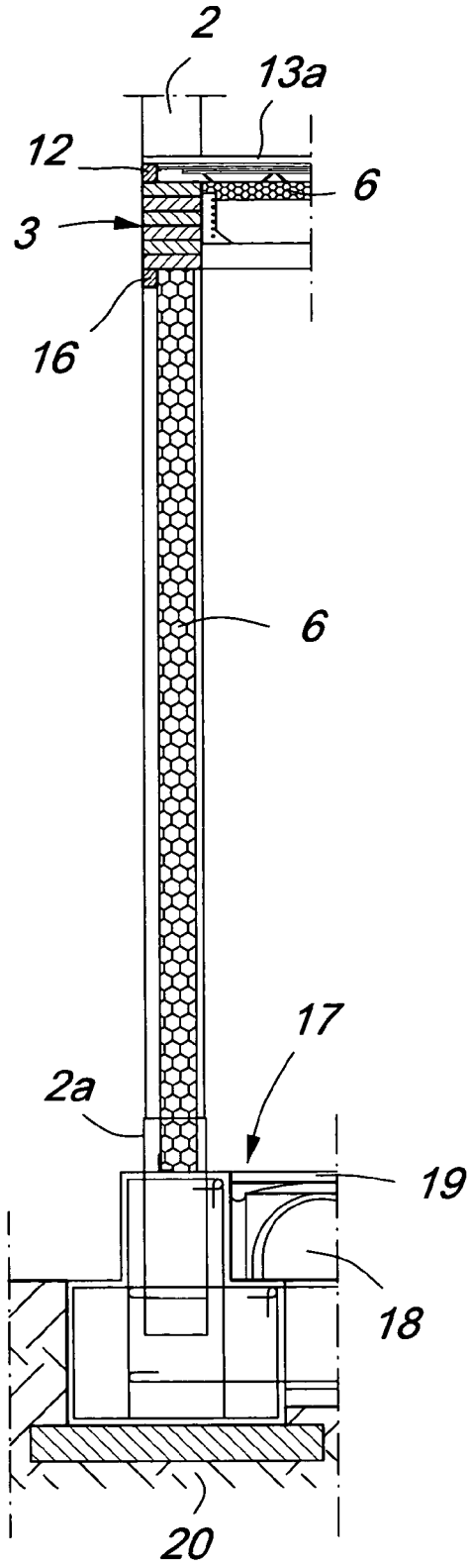
FIG. 5 is a sectional view, taken along a vertical plane, that is perpendicular to the wall that passes through the panels.
Figure 6:
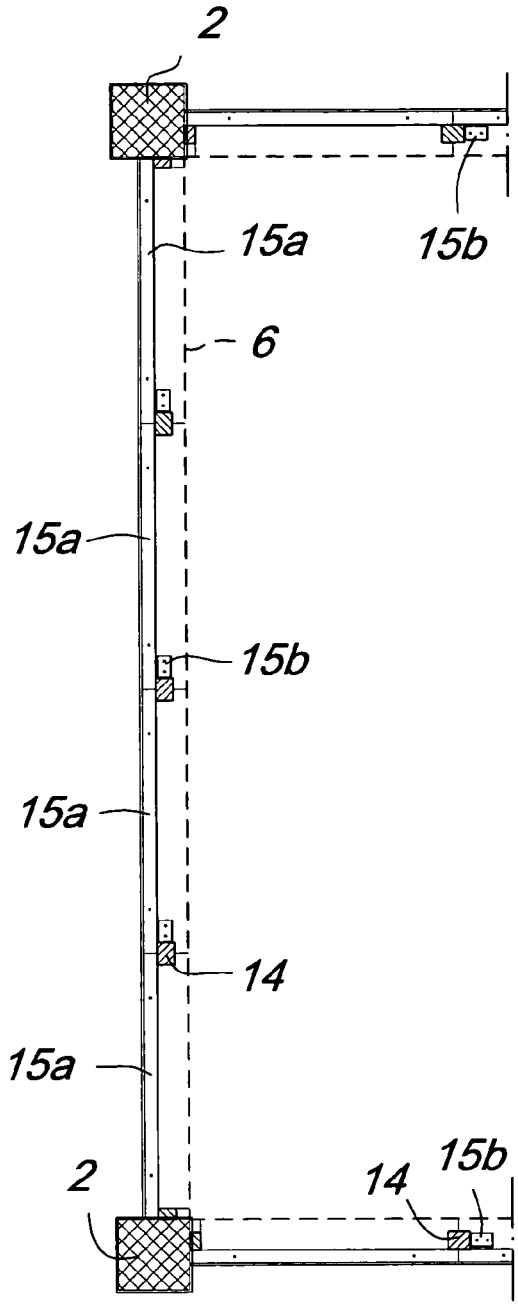
FIG. 6 is a plan view of the fixing elements of a wall that passes through the panels.
Figure 7:
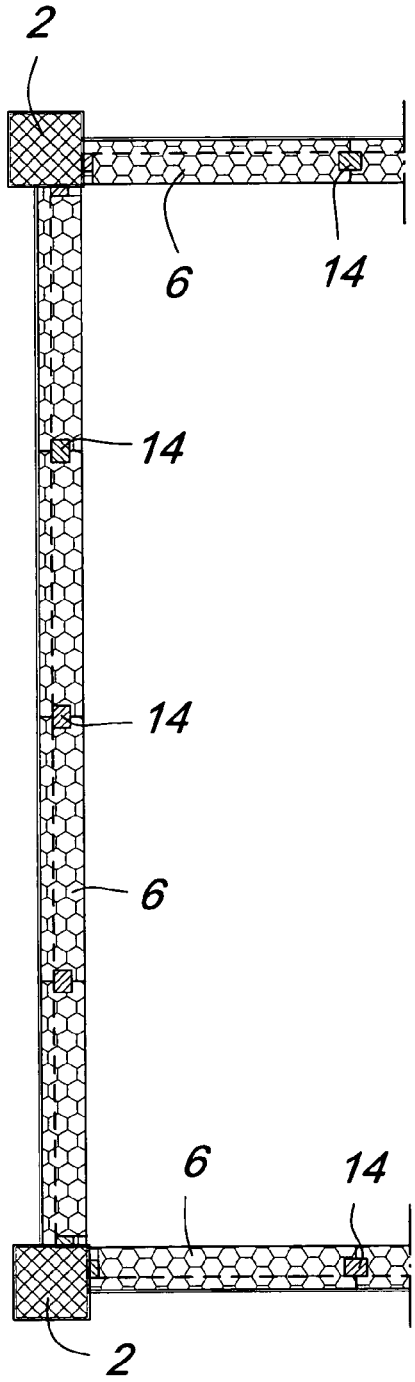
FIG. 7 is a sectional plan view, taken along a horizontal plane, of a wall built by means of the panels.
Figure 8:
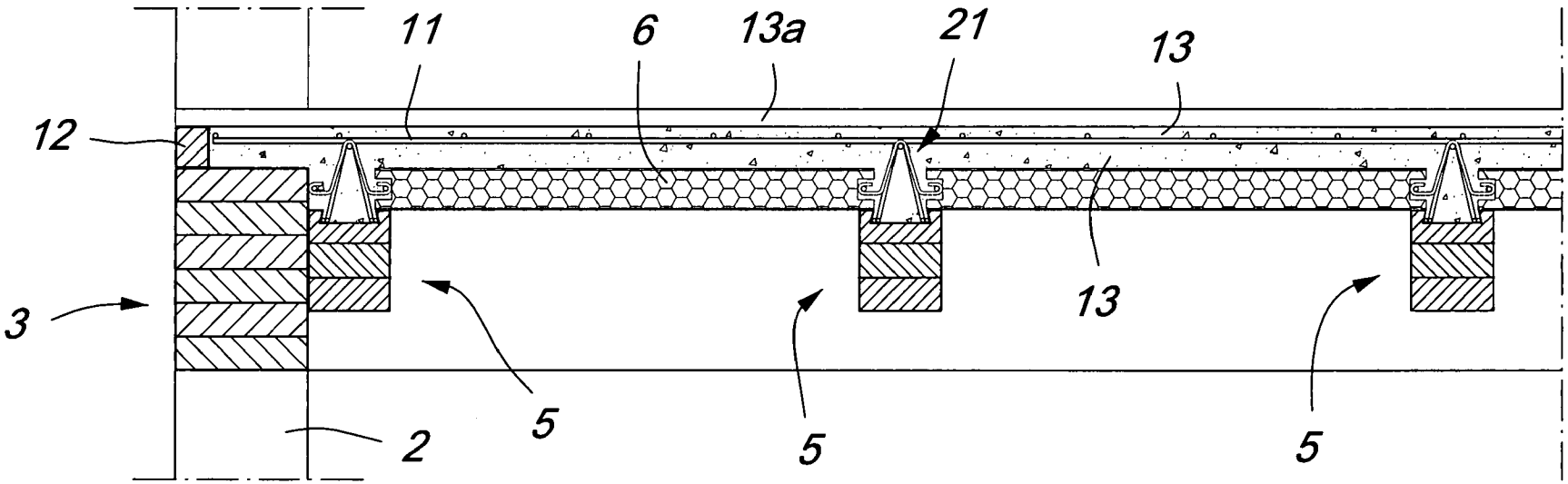
FIG. 8 is a sectional view, taken along a vertical plane that is perpendicular to a central beam, of a second embodiment.
Figure 9:
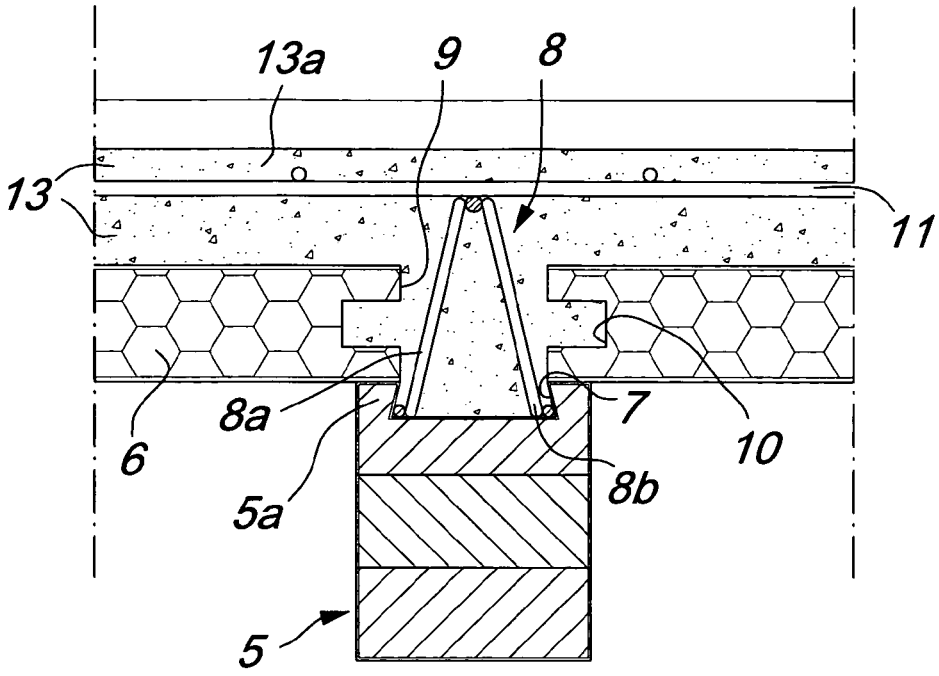
FIG. 9 is an enlarged-scale view of a detail of the coupling between the lattice and the beam in the first embodiment.
Figure 10:
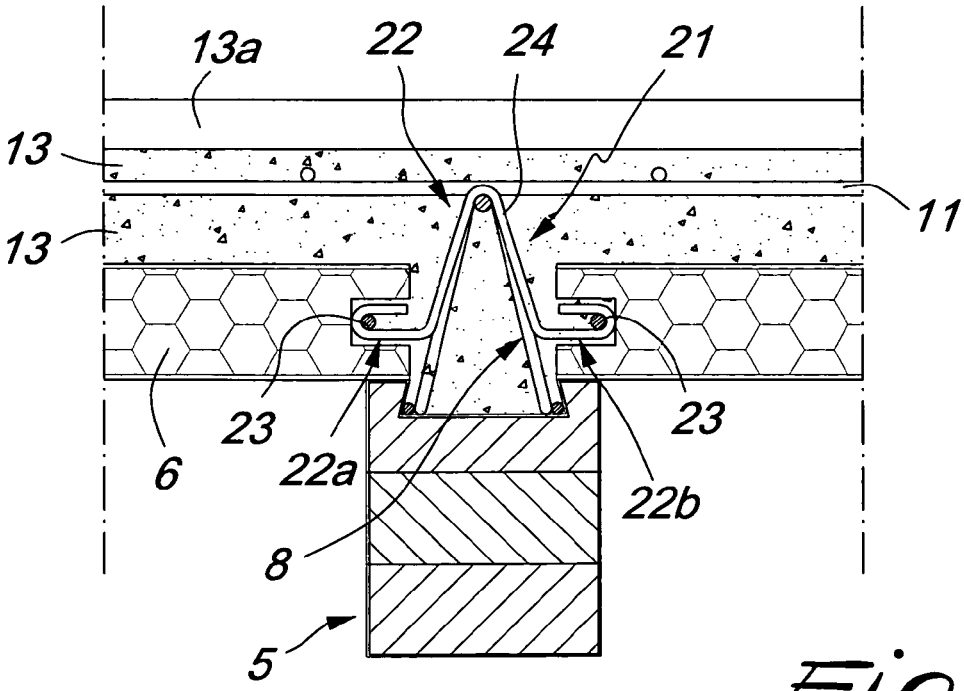
FIG. 10 is an enlarged-scale view of a detail of the coupling between the lattice and the beam in the second embodiment.
Figure 11:
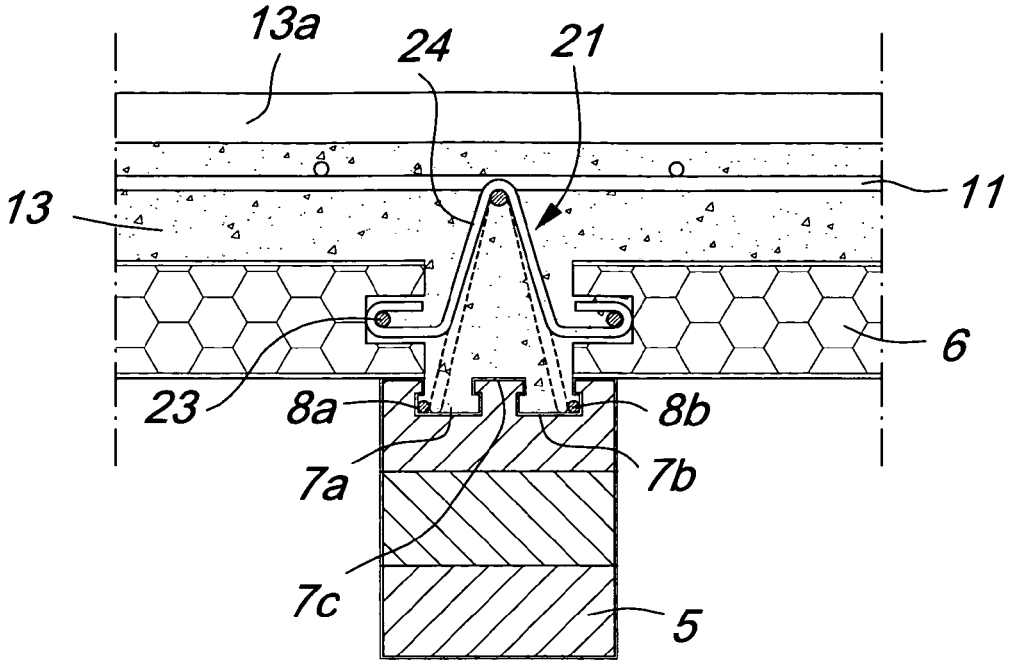
FIG. 11 is an enlarged-scale view of a detail of the coupling between the lattice and the beam in a third embodiment.
Figure 12:
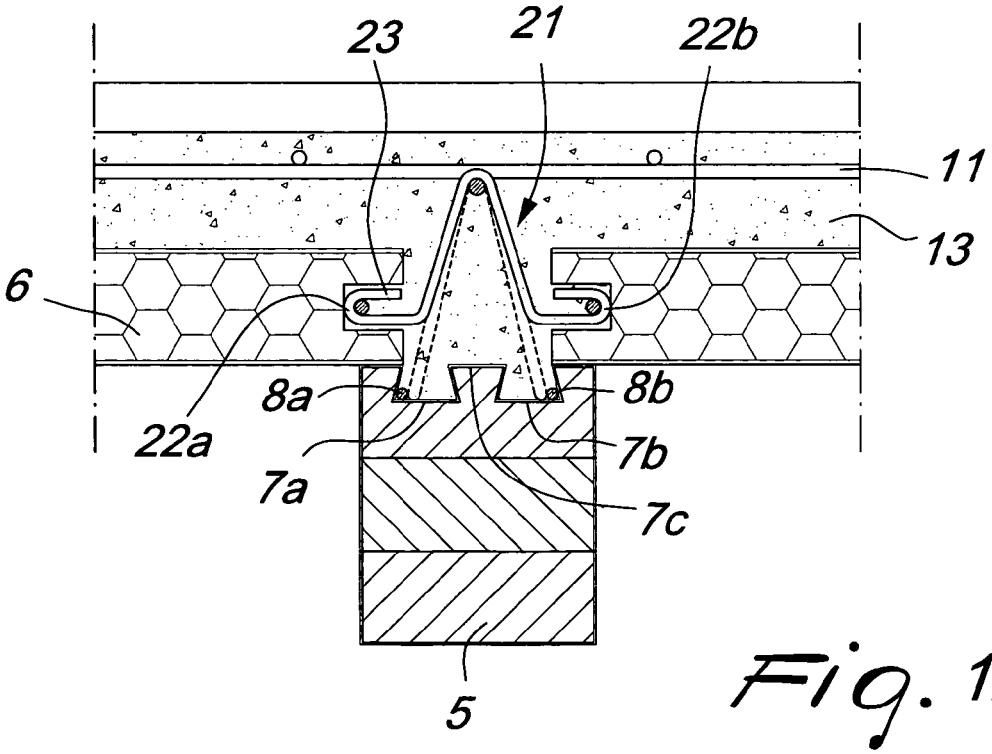
FIG. 12 is an enlarged-scale view of a detail of the coupling between the lattice and the beam in a fourth embodiment.
Figure 13:
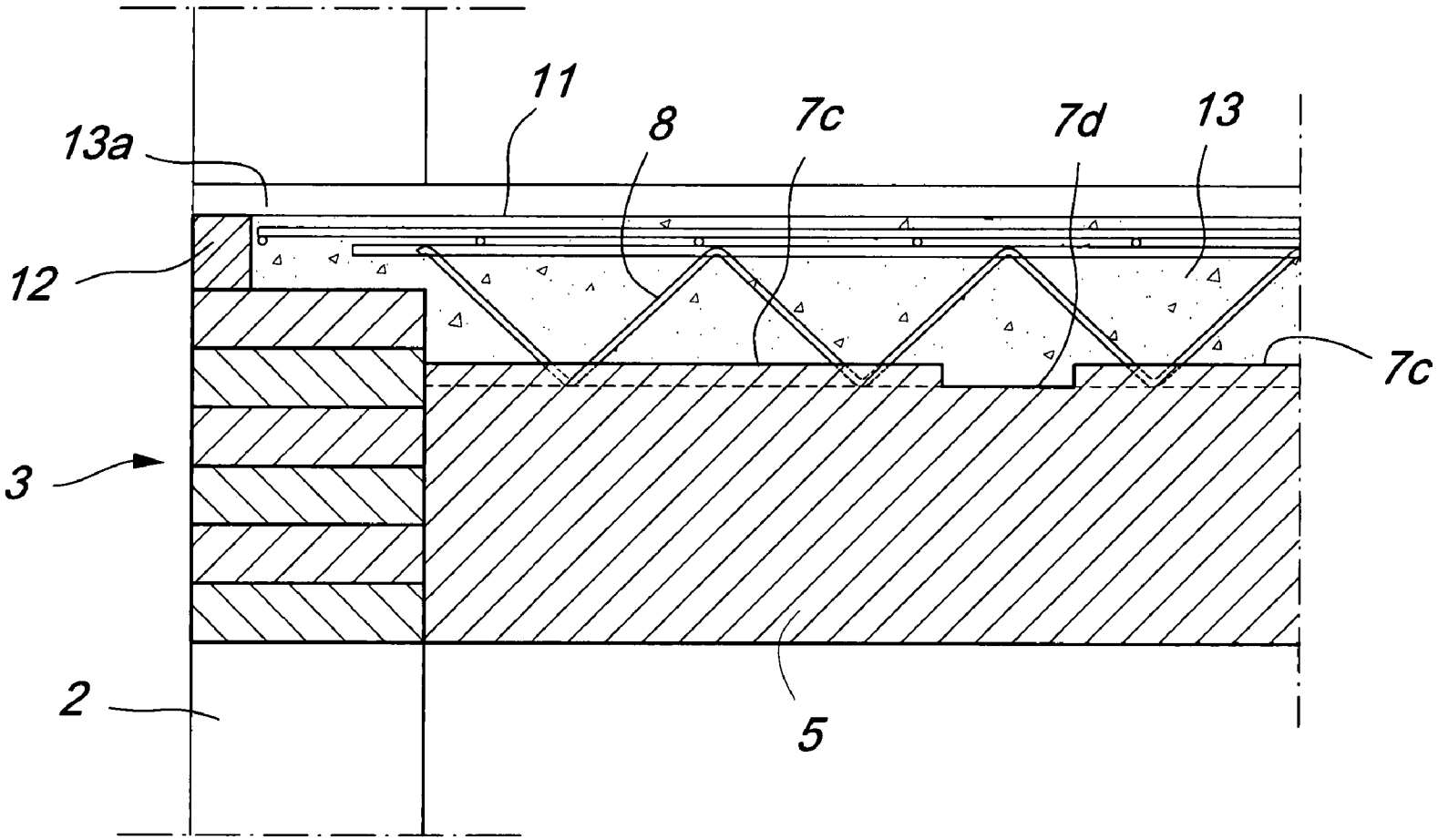
FIG. 13 is a sectional view, taken along a vertical plane that passes through a central beam.

With reference to the figures, the reference numeral 1 generally designates a floor slab provided by means of the prefabricated components according to the invention for making floor slabs, floors and walls with exposed wood beams for small buildings.

The supporting structure of the building being erected is constituted by a plurality of columns 2 made of laminated wood, which are accommodated within plinths 2*a* that are shaped complementarily to said columns, are monolithic with the supporting base, and support a plurality of upper beams 3, also made of laminated wood. Internal beams 5 or joists made of laminated wood are fixed to the upper beams 3 by means of beam supporting brackets 4 and are arranged transversely to the beams 3. The joists 5 are mutually parallel and have a center distance that is slightly greater than the length of a panel 6. Each joist 5 has, on its upper surface, coupling elements constituted by a dovetailed shallow recess 7 that is centered with respect to its axis of symmetry and forms two respective longitudinal ridges 5*a*.

The shape of the recess 7 allows the elastic forcing therein of the base of an electrowelded lattice 8 longitudinally along the entire length of each joist 5.

The lattice 8 has a triangular front cross-section and is constituted by a grid of metal rods that are distributed on two converging planes; the grid is folded so as to give continuity to the lattice 8 at the vertex edge (along the portion of the line of incidence between the two distribution planes). This configuration allows to force mutually closer the two base portions 8*a* and 8*b* of the lattice 8 in order to insert their base within the recess 7; once the forcing action is released, the two portions 8*a* and 8*b* move mutually apart (returning elastically to the initial position), locking within the recess 7.

The lattice 8 is fixed to the joist 5 by means of safety connectors (not shown in the figures); said connectors are designed to keep the lattice 8 motionless, avoiding the limited axial sliding thereof within the recess 7 during the various steps of construction.

A row of side-by-side panels 6 is arranged between two consecutive joists 5; said panels rest with their ends 9 on the ridges 5*a* of the upper surface of the joist 5.

At least two end edges of the panels 6 have centered longitudinal grooves 10.

An electrowelded net 11 can be arranged so as to rest and be coupled to the upper vertex edge of the lattice 8; since the lattices 8 protrude with respect to the upper surface of the panels 6, the net 11 lies above the described structure.

A casting containment strip 12 is provided in an upper region and at the end of each beam 3; a conglomerate 13, generally concrete, is in fact cast over the described structure and is arranged in the empty spaces, such as for example between the ends 9 of the panels 6, within the grooves 10, within the recess 7 (and therefore around the lattice 8), until it also covers completely the net 11 when a floor is provided.

When the conglomerate 13 has set, in the floor slab thus provided the structural loads are distributed among the concrete 13, the net 11, the lattices 8 and the joists 5 (obviously, all these loads are supported by the supporting structure of the building, which is constituted by the plurality of columns 2 and by the plurality of beams 3). Any kind of floor 13*a* (ceramic, terracotta, parquet, linoleum, et cetera) can be laid over the leveled upper surface of the conglomerate 13.

The groove 10 can accommodate a joining profiled element 14, also known as edge strip and generally made of wood, which is inserted partially in both of the slots 10 of two panels 6 with converging lateral surfaces, coupling them to each other: the row of panels 6 that can be formed in this manner can be fixed under a beam 3 and between two columns 2 so as to provide a wall. In an upper region with respect to the beam 3, in a lower region with respect to the floor and laterally with respect to the columns 2, the wall of panels 6 is coupled by means of angular profiled elements 15*a* and 15*b* (fixed to the ends of the joining profiled elements 14 in the case of the profiled elements 15*b*, or fixed to the upper and lower ends of the wall of panels 6 in the case of the profiled elements 15*a*) and an abutment strip 16. The unfinished wall of panels 6 is then finished by means of a cladding.

Externally, the surface of the wall is clad by means of a bonding agent (substantially constituted by a particular mix of conglomerate) with panels of clay-based material or other material (including wood, metal, ceramic or polymers); internally, in addition to the possibility to apply a cladding with materials that are similar to the ones used for the outside, the walls can also be plastered or simply filled with filler at the joining lines between the panels 6 and then painted or wallpapered (like any conventional masonry wall).

Advantageously, the flooring 16 of the building being erected can be provided with a ventilated honeycomb structure 17 made of reinforced concrete, obtained with disposable formwork and electrowelded net: the advantage of this embodiment consists of the presence of air chambers 18 between the walking surface 19 and the ground 20 on which the building rests. The air chambers, in addition to providing thermal insulation from the ground, also reduce the humidity transmitted by the ground to the building.

A second embodiment can be achieved by using locking elements consisting in a connecting frame 21 that is constituted by a lattice 8 that is coupled to a connecting frame 22: in this manner, the metallic frame embedded in the conglomerate 13 is monolithic with the joist 5 by means of the interlocking forcing of the portions 8*a* and 8*b* of the lattice 8 in the dovetail recess 7, but is also rigidly coupled to the panels 6 as a consequence of the accommodation of the portions 22*a* and 22*b* of the connecting frame 22 in the groove 10.

The connecting frame 22 is constituted by a plurality of springs 24 made of metal rod that have a central part shaped as an inverted V-letter, to which two longitudinal stems 23 are coupled: the springs 24 have the vertex connected by way of a wide arc so as to be rested on, and surround the vertex of, the lattice 8 and are inserted in the two grooves 10 of the two facing converging panels 6, rotating them; once the springs 24 have been positioned, the stems 23 are inserted longitudinally within the curved ends 22*a* and 22*b*.

According to this second embodiment, the panels 6 are monolithically coupled to the floor slab that is provided, without having to insert additional elements for their fixing.

The main advantage of the manufacture of prefabricated components according to the invention is the low weight of the panels used to provide the structural work, which allows erection without the aid of heavy machinery. Moreover, the load of the floor slabs is evenly distributed between the lattice 8 and the joist 5, thus ensuring optimum utilization of the materials.

The elements made of wood have a laminated structure; with this solution, the mechanical properties of flexural strength and compression strength are optimized and predetermined specifically according to the characteristics of the building being designed.

It has thus been shown that the invention achieves the intended aim and objects.

The invention thus conceived is susceptible of numerous modifications and variations, all of which are within the scope of the appended claims.

For example, the beams 5 can have recesses 7 provided with different shapes. It may in fact be convenient to provide joists 5 with two longitudinal recesses 7*a* and 7*b* separated by a central portion 7*c*: the purpose of such an embodiment is that it is more practical to provide the two recesses 7*a* and 7*b* than the embodiment that consists of a single wide recess 7, because in this manner the mill that machines the joist 5 has to remove less material and therefore the process is much faster. The choice to provide recesses 7*a* and 7*b* that have a substantially trapezoidal shape or are shaped like an inverted letter T leads to the provision of joists 5 that have very similar mechanical and structural characteristics: however, the process, in this case also, can be more suitable in one or the other form of the recesses 7*a* and 7*b*, depending on the system used for milling or on the type of wood used. Such an embodiment may entail axial sliding between the base portion 8*a* of the lattice 8 that lies within the recess 7*a* and the portion 8*b* that lies within the recess 7*b* (together with the corresponding concrete area 13). Mutual sliding would lead to structural problems, which can be solved by interrupting (with a gap 7*d*) the central portion 7*c* at regular intervals for a preset length. For example, it is possible to consider interrupting the central portion 7*c* every 50 centimeters for a length of 10 cm, providing transverse connections made of concrete 13 between the recess 7*a* and the recess 7*b*. Although the resulting structure has all the advantages described for the embodiment provided with the wide recess 7, it is faster to manufacture in view of the reduced amount of material to be removed.

The joists 5 and the lattice 8 are assembled in factory with a casting of conglomerate that fills the two recesses 7*a* and 7*b* and the gaps 7*d*: then the joists are assembled with the lattices and the panels in the yard and then, by casting the remaining thickness of conglomerate, the covering constituted by joists, panels and floor slab is rendered monolithic.

All the details may further be replaced with other technically equivalent ones.

In the embodiments cited above, individual characteristics, given in relation to specific examples, may actually be interchanged with other different characteristics that exist in other embodiments.

Subject-matter already known at the conceiving date of the invention is not considered to be comprised in the scope of the claims and is hereby inherently disclaimed.

In practice, the materials used, as well as the shapes and the dimensions, may be any according to requirements without thereby abandoning the scope of the protection of the appended claims.

The disclosures in Italian Patent Application No. B02003A000046 from which this application claims priority are incorporated herein by reference.

What is claimed is:

1. Prefabricated components for making floor slabs, floors and walls with exposed wood beams for small buildings, comprising:

a plurality of laminated panels, each of which has longitudinal grooves on at least two mutually opposite edges thereof to form grooved edges of said laminated panels;

laminated wood joists;

central metallic lattices;

coupling elements provided at an upper region of said wood joists for coupling to a respective central metallic lattice of said metal lattices, said coupling elements comprising at least one supporting ridge for supporting ends of said laminated panels constituted by converging ones of said grooved edges, and wherein said joists, said lattices and said converging grooved edges are coupled to each other with a casting conglomerate.

2. The components of claim 1, wherein said coupling elements for coupling respective central metallic lattices are constituted by at least one dovetailed longitudinal recess that has a limited height and a narrow inlet, said longitudinal recess being provided on an upper surface of each of said laminated wood joists, said lattices having a substantially triangular transverse cross-sectional shape adapted to couple by elastic forcing and insertion of a base region of said lattice within said recess.

3. The components of claim 2, comprising an electrowelded metal net rested and coupled on a crest of said lattices, said metal net being embedded in said conglomerate distributed on the surface of the panels.

4. The components of claim 3, comprising metallic reinforcement rods distributed so as to rest on the panels and be inserted within a grid formed by the lattices, said rods being embedded in said conglomerate that is distributed on the surface of the panels.

5. The components of claim 2, comprising locking elements that surmount said joists for locking said ends of the panels that rest thereon.

6. The components of claim 4, comprising locking elements that surmount said joists for locking said lattice.

7. The components of claim 6, wherein said locking elements comprise a plurality of springs made of metal rod, which surmount said lattice and are coupled thereto, said locking elements being adapted to couple, with respective lateral ends thereof, the rods that are arranged longitudinally within the grooves of the facing panels.

8. The components of claim 7, wherein said springs are each provided with a central part that is shaped like an inverted letter V, with a vertex thereof connected by way of a wide arc so as to surround without forcing a vertex region of the lattice and with two bent lateral ends that are insertable in said grooves.

9. The components of claim 8, wherein said longitudinal rods are locked within said lateral bent ends.

10. The components of claim 1, comprising joining profiled elements with transverse dimensions that are twice the depth of each one of said grooves, said joining profiled elements being insertable with interlocking, within facing ones of said grooves of two respective converging panels, arranged side by side so as to constitute a flat surface.

11. The components of claim 10, comprising spaced columns that are connected by way of upper beams with respective said lattices, and a horizontal supporting surface, which delimit areas that are occupied by rows of said plurality of panels arranged side by side and mutually anchored by said joining profiled elements so as to constitute panel walls, with each panel wall being fixed along a perimeter thereof, and each joining profiled element being provided with, and fixed at, ends thereof by way of angular anchoring elements, to said columns, to said upper beams and to said supporting surface.

12. The components of claim 11, wherein said wall has an outer cladding made of building material that is fixed thereto by way of a mixture of conglomerate that is suitable to act as a bonding agent.

13. The components of claim 12, wherein said wall outer cladding is made of clay-based material.

14. The components of claim 12, wherein said outer cladding is made of exposed stone.

15. The components of claim 12, wherein said outer cladding is made of ceramic.

16. The components of claim 12, wherein said outer cladding is made of wood.

17. The components of claim 12, wherein said outer cladding is made of plastic laminated elements.

18. The components of claim 12, wherein said outer cladding is made of metallic laminated elements.

19. The components of claim 11, wherein said wall has an internal cladding constituted by a thin layer of a mixture of conglomerate that is suitable to act as a plaster.

20. The components of claim 11, wherein said wall has an internal cladding made of building material that is fixed thereto by way of a mixture of conglomerate that is suitable to act as a bonding agent.

21. The components of claim 20, wherein said building material that constitutes the internal cladding is plasterboard.

22. The components of claim 20, wherein said building material that constitutes the internal cladding is wood.

23. The components of claim 20, wherein said building material that constitutes the internal cladding is upholstery material.

24. The components of claim 2, wherein said coupling elements are constituted by a wide dovetail recess.

25. The components of claim 2, wherein said coupling elements are constituted by pairs of dovetail recesses.

26. The components of claim 2, wherein said coupling elements are constituted by two recesses that are shaped like an inverted letter T.

27. The components of claim 25, comprising a central separation portion formed between the pairs of recesses, said separation portion being interrupted for a selected length and with a selected pitch in order to mutually connect the conglomerate castings in the pairs of recesses.

* * * * *